United States Patent [19]

Bienvenue et al.

[11] 4,319,156

[45] Mar. 9, 1982

[54] VEHICLE HEADLIGHT HAVING DUAL FILAMENT TUNGSTEN HALOGEN LAMP

[75] Inventors: Roland L. Bienvenue, Lawrence; Herbert L. Walton, Newburyport, both of Mass.

[73] Assignee: GTE Products Corporation, Stamford, Conn.

[21] Appl. No.: 176,899

[22] Filed: Aug. 11, 1980

Related U.S. Application Data

[62] Division of Ser. No. 938,999, Sep. 1, 1978, Pat. No. 4,262,229.

[51] Int. Cl.[3] ..... H01J 5/16

[52] U.S. Cl. ..... 313/113; 362/211; 362/267

[58] Field of Search ..... 313/113, 316, 318, 222

[56] References Cited

U.S. PATENT DOCUMENTS

| | | | |
|---|---|---|---|
| 3,917,939 | 11/1975 | Schmidt et al. | 313/113 X |
| 3,979,627 | 9/1976 | Leadvaro et al. | 313/315 |
| 4,028,577 | 6/1977 | Gates et al. | 313/315 X |
| 4,140,939 | 2/1979 | Bonazoli et al. | 313/222 |
| 4,149,103 | 4/1979 | Gates et al. | 313/318 X |
| 4,166,232 | 8/1979 | Kimball et al. | 313/316 |
| 4,181,869 | 1/1980 | Warren et al. | 313/331 X |

FOREIGN PATENT DOCUMENTS

| | | | |
|---|---|---|---|
| 2023339 | 12/1979 | United Kingdom | 313/113 |

*Primary Examiner*—Robert Segal

*Attorney, Agent, or Firm*—Lawrence R. Fraley

[57] ABSTRACT

A tungsten-halogen incandescent lamp which includes a vitreous envelope, an inert gas and halogen fill, and two pairs of straight, parallel lead-in wires retained within the envelope's press-sealed end, each of said pairs having a tungsten filament supported thereon within the envelope. The pairs of wires occupy respective parallel planes within the press-sealed end with one pair laterally offset from the other. A method for making the lamp is also disclosed, in addition to a vehicle headlight particularly suited for utilizing the lamp.

4 Claims, 5 Drawing Figures

VEHICLE HEADLIGHT HAVING DUAL FILAMENT TUNGSTEN HALOGEN LAMP

This is a division of application Ser. No. 938,999 filed Sept. 1, 1978, now U.S. Pat. No. 4,262,229, granted Apr. 14, 1981.

CROSS REFERENCE TO RELATED PATENTS

An application entitled "Tungsten Halogen Capsule for Headlight" (Inventors: S. F. Kimball et al) was filed Mar. 13, 1978 and assigned to the assignee of the present invention. The application is now listed in the Patent and Trademark Office under Ser. No. 886,252, now U.S. Pat. No. 4,181,869, granted Jan. 1, 1980, and describes a tungsten-halogen, dual filament lamp particularly suited for vehicle headlights.

Another Application, entitled "Tungsten Halogen Lamp in Reflector Envelope" (Inventors: B. J. Warren et al) was filed Mar. 6, 1978 and also assigned to the assignee of the present invention. This application is listed under Ser. No. 883,863 and describes a rectangular vehicle headlight which utilizes a tungsten-halogen incandescent lamp therein.

Still another application was filed Apr. 26, 1978 and entitled "Improved Tungsten Halogen Lamp For Headlight" (Inventors: R. P. Bonazoli et al). This Application, assigned to the assignee of the present invention, is listed in the Patent and Trademark Office under Ser. No. 900,048, now U.S. Pat. No. 4,140,939, granted Feb. 20, 1979, and describes a dual filament tungsten-halogen lamp wherein the filaments are laterally offset from each other.

BACKGROUND OF THE INVENTION

The invention relates to tungsten-halogen incandescent lamps and particularly those of the dual filament variety especially suited for use in vehicle headlights.

The invention also relates to methods of producing such lamps.

In tungsten-halogen lamps, the tungsten is normally evaporated from the filaments during operation and combines with the halogen to form a gaseous halide, which prevents the tungsten from depositing on the internal wall of the lamp's envelope. Upon returning to the tungsten filaments, the halide decomposes, resulting in the deposition of tungsten back onto the filaments and the release of additional halogen gas to assure continuation of the cycle. The halogen cycle is well known in the art and lamps employing it have been on the market for some time.

With particular regard to dual filament tungsten-halogen lamps such as those described in the aforementioned applications, it was heretofore considered necessary to subject each of the several, e.g., four, lead-in wires used in the lamp to a series of complex bending operations prior to securement of the wires within the press-sealed end of the lamp's envelope. These operations were deemed essential to assure proper orientation of the respective tungsten filaments which typically are secured to the ends of the lead-in wires which extend within the envelope. Understandably, errors during these bending operations can result in unacceptable variations in filament locations and accompanying rejection rates during manufacture. Additionally, because the four wires were positioned within the press sealed end in a planar relationship, a potential "bumping" problem existed whenever it was decided to further include wire support members within the envelope's press-sealed end. In the final headlight assembly, mounting rods are affixed to these support members to assure secured alignment of the lamp within the assembly. "Bumping" occurs when the end of the support members engage one or more of the positioned lead-in wires. Because placement of the wire support members typically occurs simultaneously with the press-sealing operations, "bumping" can cause misalignment of both the lead-in wires and the support members, in addition to electrical short-circuiting in the final assembly. There is also the possibility of an improper seal between these metal components and the respective glass envelope which may in turn adversely affect the operating characteristics of the final product.

It is believed, therefore, that an incandescent, dual filament tungsten-halogen lamp which obviates the aforedescribed disadvantages of known lamps, of this variety would constitute a significant advancement in the art.

OBJECTS AND SUMMARY OF THE INVENTION

It is, therefore, a primary object of this invention to provide a new and useful tungsten-halogen incandescent lamp which possesses several advantages over similar prior art lamps.

It is another object of the invention to provide a method for making a tungsten halogen lamp.

It is yet another object of the invention to provide a vehicle headlight which utilizes the above lamp.

In accordance with one aspect of the invention, there is provided a tungsten-halogen incandescent lamp which comprises an envelope having a press-sealed end portion, an inert gas and halogen fill within the envelope, two pairs of lead-in wires sealed within the envelope's press-sealed end, each pair occupying a plane with both planes substantially parallel to each other, and a pair of tungsten filaments, each supported on the ends of a respective one of the pairs of lead-in wires. One pair of lead-in wires is laterally offset from the other within the press-sealed end.

In accordance with another aspect of the invention, a vehicle headlight is provided which comprises a concave glass member, a cover hermetically sealed thereto, the aforedescribed tungsten-halogen lamp positioned within the glass member, and a plurality of terminals also positioned within the glass member and projecting therefrom. The terminals are electrically connected to the tungsten filaments via the lead-in wires.

DETAILED DESCRIPTION OF THE PREFERRED EMBODIMENTS

For a better understanding of the present invention together with other and further objects, advantages, and capabilities thereof, reference is made to the following disclosure and appended claims in connection with the above-described drawings.

Figure 1:
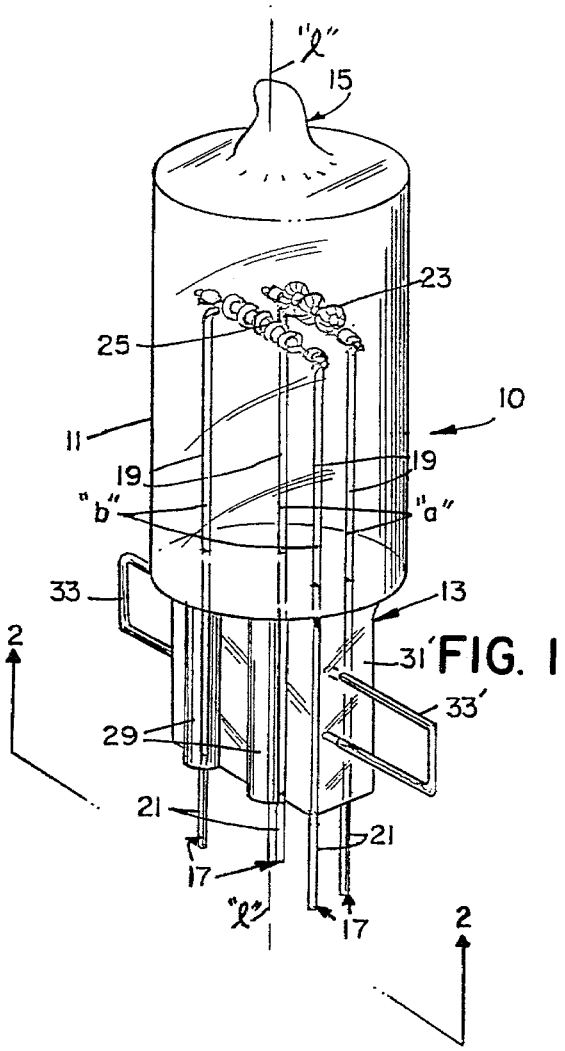
FIG. 1 is an isometric view of a tungsten-halogen incandescent lamp in accordance with one embodiment of the invention.

In FIG. 1 there is shown a tungsten-halogen incandescent lamp 10 in accordance with a preferred embodiment of the invention. Lamp 10 includes a hermetically sealed envelope 11 having a press-sealed first end portion 13 and a tip-sealed second end portion 15. Envelope 11 is of vitreous material, e.g. hard glass or quartz, and is of substantially tubular, elongated configuration. A hard glass that has been found particularly suitable for use as envelope 11 is alumino-silicate, such as Corning 1720 glass. This material operates reliably at temperatures up to 500° C. yet is much less expensive than quartz. Further, at the room temperature setting point, aluminosilicate glass has a coefficient of thermal expansion of about $52\times10^{-7}$ in./in./°C., which makes it ideally suited for use with molybdenum, the preferred material for the lamp's lead-in wires 17. Molybdenum has a thermal expansion of approximately $55\times10^{-7}$ in./in./°C. Accordingly, this envelope material permits a simple match seal to be used in securement of the lead-in wire 17 within press-sealed end 13, thereby obviating the need for an intermediate molybdenum ribbon connection typically employed in quartz seals.

Envelope 11 is filled with an inert gas, such as argon, nitrogen, krypton, or a mixture thereof, and a halogen additive such as bromine, for example, in the form of hydrogen bromide. The total pressure of the admixed halogen and inert fill gas may range from 2 to 7 atmospheres, at room temperature, depending upon the fill gas composition and the voltage, lumen and life ratings for which the lamp is designed.

Lead-in wires 17 are straight and parallel, and are oriented in first and second pairs "a" and "b", respectively, of two wires each. The use of straight, parallel wires in the present invention overcomes the earlier need for complex bending operations during formation of these members. Thus, orientation of wires 17 and the lamp's filaments within envelope 11 is greatly facilitated. Additionally, the previous need for precisioned bending devices and/or similar equipment has been eliminated, thereby reducing manufacturing costs of lamp 10 in comparison to earlier varieties.

Figure 2:
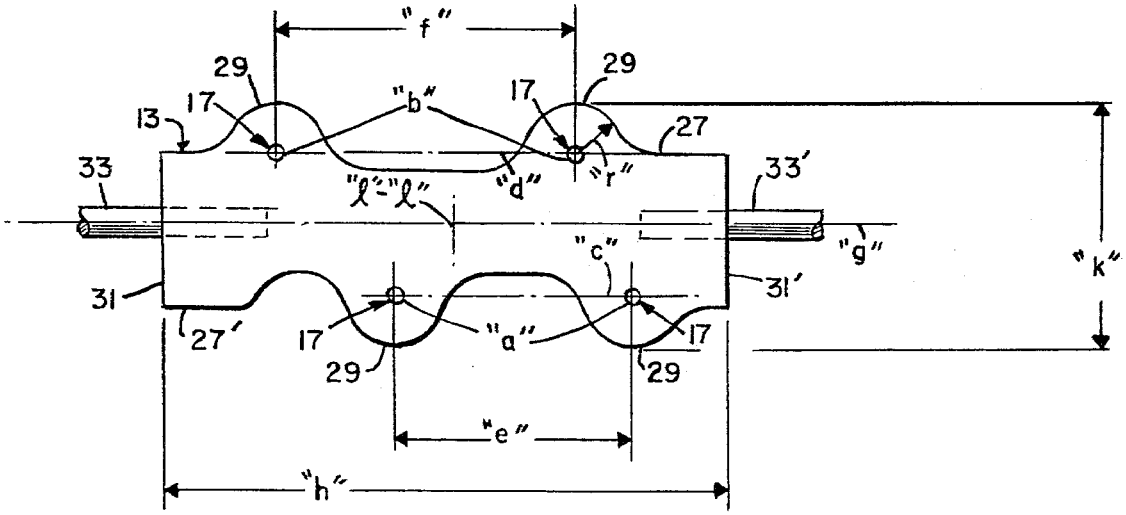
FIG. 2 is a bottom view of the lamp of FIG. 1 as taken along the line 2—2 in FIG. 1.

The first and second pairs of wires 17 occupy first and second spaced apart, parallel planes "c" and "d", respectively, which in turn are parallel to and lie on opposing sides of the lamp's longitudinal axis "l"—"l" when viewed from the press-sealed end of the lamp (FIG. 2). Accordingly, each of the lead-in wires 17 are also parallel to axis "l"—"l". Pair "a" is laterally offset from pair "b" and the wires therein are spaced apart at a lesser distance ("e") than the wires in pair "b" ("f"). By laterally offset is meant that one end wire of pair "a" extends beyond the corresponding end wire of pair "b" on one side of the array while on the opposing side, the end wire of pair "b" extends beyond the corresponding end wire of pair "a". In the arrangement of FIG. 2, these dimensions are approximately 0.038 inch and 0.113 inch, respectively. In other words, the end wire (top, left in FIG. 2) of pair "b" extends about three times the distance from pair "a" than the opposing end wire (bottom, right in FIG. 2) of pair "a" from pair "b".

It is also preferred in the arrangement of FIG. 2 that the respective centers of each pair of wires be offset with respect to longitudinal axis "l"—"l", and preferably on opposing sides thereof. That is, in the arrangement shown in FIG. 2, the center of pair "a" is offset to the right of axis "l"—"l" (approximately 0.057 inch) and the center of pair "b" is offset to the left of axis "l"—"l" (approximately 0.019 inch). In one example of the invention, wires 17 were each 0.013 inch diameter and spacings "e" and "f" were 0.206 inch and 0.281 inch, respectively. Additionally, each of the parallel planes "c" and "d" were spaced at a distance of 0.050 inch from axis "l"—"l".

Each lead-in wire 17 includes a first end 19 which projects within envelope 11 and a second end 21 which passes through press-sealed portion 13 and extends therefrom externally of the envelope. As will be described, ends 21 are electrically connected to respective electrical conductors when the lamp is in operation, e.g. within a vehicle headlight.

Supported on first ends 19 of pair "a" of wires 17 and electrically joined thereto is a first tungsten filament 23, preferably of coiled construction. Similarly, a second, somewhat smaller in diameter coiled tungsten filament 25 is supported and electrically joined to the first ends of the wires of pair "b".

Figure 4:
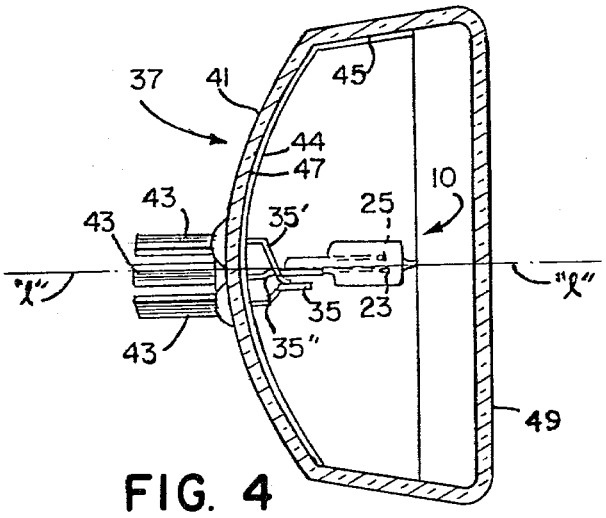
FIG. 4 is a side elevational view, partly in section, of a dual filament vehicle headlight in accordance with one embodiment of the invention.

Filament 23 serves as the high beam filament while filament 25 serves as the low or dip beam filament when lamp 10 is utilized as part of a vehicle headlight (FIG. 4). Filaments 23 and 25 are parallel and substantially orthogonal to longitudinal axis "l"—"l", in addition to also being laterally offset therefrom. Understandably, these components are offset in the same manner as the lead-in wires 17 in sealed portion 13. Both filaments also preferably lie in the same plane. Filament 23, made of 50 mg./200 mm. tungsten wire, is preferably a coiled coil filament; that is, after the wire is subjected to a first coiling operation, the coiled member is then again coiled. The overall diameter is preferably 0.058 inch and the body length is, of course, approximately equal to the aforementioned dimension "e". Filament 25, made also of 50 mg./200 mm. tungsten wire, is preferably a single or once-coiled filament having an overall diameter of 0.037 inch, and a length approximately equal, of course, to the above dimension "f". The filaments are spaced about 0.050 inch apart within lamp 10.

With further regard to FIG. 2, press-sealed end 13 includes a pair of opposing, longitudinal side walls 27, 27' which each include two undulating portions 29 therein. Each portion 29 is designed to accommodate a single lead-in wire 17. The preferred radius ("r") for each portion 29 is 0.045 inch. End 13 also includes a pair of opposing, substantially planar and parallel end walls 31, 31'. The above configuration for end 13 assures positive securement of wires 17 therein while minimizing the quantity of glass needed for this portion of lamp 10. This configuration adds yet another significant feature to the present invention, that being the enhanced accommodation of wire support members (33, 33'), which are preferably utilized in lamp 10 to facilitate positioning and electrical connecting of the lamp and lead-in wires, respectively, when lamp 10 is employed in the desired, final product. In previous lamps wherein all of the lead-in wires occupied the same plane as that of the lamp's axis "l"—"l" positioning of the wire support members within end 13 presented the potential "bumping" problem described above. The configuration shown in FIG. 2 eliminates this possibility, in addition to permitting deeper penetration by members 33, 33' within end 13. The overall result of this feature is that the supports are more securely retained within end 13 and the possibility of electrical short-circuiting between these members and one or more of the lead-in wires 17 has been substantially removed. In one embodiment of the invention, support members 33, 33' each were embedded a depth of about 0.082 inch within end walls 31 and 31', respectively. Members 33, 33' are preferably of rodar or kovar material and have a diameter of about 0.025 inch. As shown in FIG. 2, these members occupy a third plane "g" located between and parallel to planes "c" and "d", and also occupied by longitudinal axis "l"—"l". The overall length ("h") for end 13 is about 0.500 inch and the thickness or width "k") is about 0.190 inch.

Figure 3:
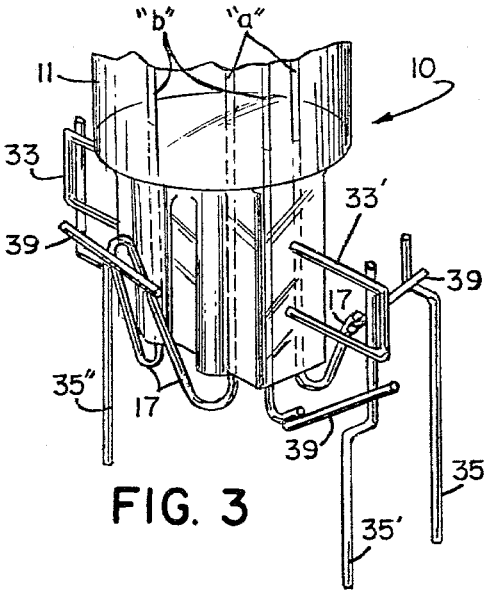
FIG. 3 is a partial isometric view of the lamp of FIG. 1 including the preferred mounting rod and connecting wire arrangements of the invention.

In FIG. 3, lamp 10 is shown as further including a plurality, e.g. three, of mounting rods 35, 35', 35'' which, as will be described are utilized to facilitate positioning and electrical connection of lamp 10 within the desired, final product such as a vehicle headlight 37 (FIG. 4). A first rod 35 is electrically connected, via a connecting wire 39 to one of the extending wires 17 from first pair "a". A second rod 35' is similarly connected to one wire from pair "b". Both of the remaining wires from pairs "a" and "b" are connected to a third rod 35''.

To also assure that lamp 10 maintains the required precise alignment within headlight 37, second and third rods 35' and 35'' are welded to supports 33' and 33, respectively, and thereafter securely positioned within the headlight. Rods 35, 35', and 35'' are preferably nickel, each having a diameter of about 0.070 inch. The three are spacedly positioned within a concave glass member 41 of headlight 37 and each electrically connected to a respective terminal 43 which projects from member 41. Understandably, terminals 43 are connected via rods 35, 35', and 35'' to lead-in wires 17 and therefore to filaments 23 and 25 in the same manner that said rods are connected. Accordingly, it is understood that each of the terminals could comprise an extension of the respective mounting rod to which it is attached, rather than a separate member as shown. Terminals 43 are adapted for plugging into a corresponding socket member (not shown) which forms part of the vehicle's electrical system. Lamp 10 is shown in FIG. 4 as being located substantially within member 41. Preferably, the longitudinal axis "l"—"l" of lamp 10 lies on the optical axis of concave reflector member 41. A thin layer 44 of reflective material, e.g. vapor-deposited aluminum, is provided on the glass member's upper and back internal surfaces 45 and 47, respectively, to enhance forward light output from headlight 37.

The orientation of headlight 37 as depicted in FIG. 4 represents the preferred manner in which this component will be positioned within a respective vehicle. That is, low beam filament 25 will be located above high beam filament 23. Accordingly, when only low beam filament 25 is in operation, the primary direction for the light from headlight 37 will be both forward and downward. Simultaneous operation of both filaments will result in a more upward direction of light output.

Headlight 37 includes a transparent glass cover 49 which is hermetically sealed, e.g. with a suitable epoxy, to concave member 41. Cover 49 is preferably of rectangular configuration. In one example, headlight 37 possessed an operating voltage of 12.8 volts at both low and high beams, an operating wattage of 35 watts at both beams, and a maximum current of 2.94 amperes at both beams. Headlight 37 was rated as having an operational life of 320 hours at low beam and 200 hours at high beam.

Figure 5:
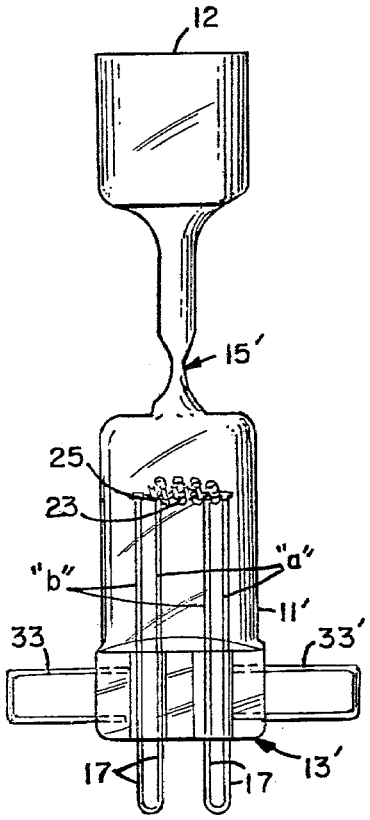
FIG. 5 represents one of the steps in making a dual filament tungsten-halogen lamp in accordance with one embodiment of the invention.

The first step of producing lamp 10 involves positioning both pairs of lead-in wires in a suitable, metallic holder (not shown), said wires having the tungsten filaments supported thereon. One wire from each pair is joined (in a U-shaped manner) to a corresponding wire in the adjoining pair, as depicted in FIG. 5. The purpose of the holder is to maintain the wires in the orientation illustrated in FIG. 2.

This entire assembly was next inserted into the first, open end (13') of glass tubing 11 which had been necked down to the shape illustrated in FIG. 5. End 13' was heated to the working temperature of the glass and a press-seal was formed at the end, securing wires 17 therein. Simultaneously, side support members 33 and 33' were embedded within the heated glass material. When the formed press-seal cooled below its softening point, the metallic holder was removed. Tubing 11' was then exhausted through the remaining open end 12 and thereafter filled with the aforedescribed inert gas and halogen. The tubing was then tip-sealed (at section 15') to produce a finished lamp having the configuration shown in FIG. 1. Attachment of the mounting rods and connecting wires shown in FIGS. 3 and 4 was next accomplished whereupon lamp 10 was suitable for final orientation and securement within the concave glass member of headlight 37.

While there have been shown and described what are at present considered the preferred embodiments of the invention, it will be obvious to those skilled in the art that various changes and modifications may be made therein without departing from the scope of the invention as defined by the appended claims.

What is claimed is:

1. A vehicle headlight comprising:

a substantially concave glass member including an internal surface having a layer of reflective material thereon:

a transparent glass cover hermetically sealed to said concave glass member:

a tungsten-halogen incandescent lamp positioned within said concave glass member, said incandescent lamp including a substantially tubular vitreous envelope having a press-sealed first end portion and a tip-sealed second end portion, said press-sealed first end portion of said glass envelope including a pair of opposing longitudinal side walls each having two undulating portions therein, a fill of an inert gas and halogen within said envelope, first and second pairs of straight and parallel lead-in wires sealed within said press-sealed end portion of said envelope, each of said lead-in wires having a first end projecting within said envelope and a second end extending from said envelope, the portions of each of said lead-in wires sealed within said press-sealed first end portion of said glass envelope being substantially positioned within a respective one of said undulating portions, said first pair of lead-in wires occupying a first plane and said second pair of lead-in wires occupying a second plane substantially parallel to said first plane, said first pair of lead-in wires being laterally offset from said second pair within said press-sealed first end portion, and first and second spaced apart tungsten filaments supported within said envelope by said first ends of said first and second pairs of lead-in wires, respectively; and a plurality of terminals spacedly positioned within and projecting from said concave glass member, said lead-in wires electrically connecting said terminals to said tungsten filaments.

2. The vehicle headlight according to claim 1 wherein the number of said terminals is three, a first of said terminals electrically connected to the second end of one of said lead-in wires from said first pair of wires, a second of said terminals electrically connected to the second end of said lead-in wires from said second pair of lead-in wires, and a third of said terminals electrically connected to both remaining second ends of said lead-in wires from said first and second pairs of wires.

3. The vehicle headlight according to claim 2 including three mounting rods, each of said mounting rods securedly positioned within said concave glass member and electrically connecting one of said terminals to the respective second ends of said lead-in wires.

4. The vehicle headlight according to claim 3 including a pair of wire support members embedded within said press-sealed end portion of said envelope each of at least two of said mounting rods securedly attached to a respective one of said wire support members.

* * * * *